US009806415B2

(12) United States Patent
Chen et al.

(10) Patent No.: US 9,806,415 B2
(45) Date of Patent: Oct. 31, 2017

(54) MODULATION PATTERNS FOR SURFACE SCATTERING ANTENNAS

(71) Applicant: Searete LLC, Bellevue, WA (US)

(72) Inventors: Pai-Yen Chen, Houston, TX (US); Tom Driscoll, San Diego, CA (US); Siamak Ebadi, Redmond, WA (US); John Desmond Hunt, Seattle, WA (US); Nathan Ingle Landy, Mercer Island, WA (US); Melroy Machado, Seattle, WA (US); Milton Perque, Jr., Seattle, WA (US); David R. Smith, Durham, NC (US); Yaroslav A. Urzhumov, Bellevue, WA (US)

(73) Assignee: The Invention Science Fund I LLC

( * ) Notice: Subject to any disclaimer, the term of this patent is extended or adjusted under 35 U.S.C. 154(b) by 93 days.

(21) Appl. No.: 15/010,140

(22) Filed: Jan. 29, 2016

(65) Prior Publication Data

US 2016/0149309 A1 May 26, 2016

Related U.S. Application Data

(63) Continuation of application No. 14/549,928, filed on Nov. 21, 2014, which is a continuation of application No. 14/510,947, filed on Oct. 9, 2014, now abandoned.

(51) Int. Cl.

| | |
|---|---|
| ***H01Q 11/02*** | (2006.01) |
| ***H01Q 3/44*** | (2006.01) |
| ***H01Q 13/20*** | (2006.01) |

(52) U.S. Cl.
CPC ..... *H01Q 3/44* (2013.01); *H01Q 11/02* (2013.01); *H01Q 13/20* (2013.01)

(58) Field of Classification Search
CPC ..... H01Q 3/44; H01Q 11/02; H01Q 13/20
See application file for complete search history.

(56) References Cited

U.S. PATENT DOCUMENTS

| | | | |
|---|---|---|---|
| 3,001,193 | A | 9/1961 | Marie |
| 3,714,608 | A | 1/1973 | Barnes et al. |
| 4,291,312 | A | 9/1981 | Kaloi |
| 4,489,325 | A | 12/1984 | Bauck et al. |
| 4,672,378 | A | 6/1987 | Drabowitch et al. |
| 4,874,461 | A | 10/1989 | Sato et al. |
| 4,920,350 | A | 4/1990 | McGuire et al. |
| 4,978,934 | A | 12/1990 | Saad |

(Continued)

FOREIGN PATENT DOCUMENTS

| | | | |
|---|---|---|---|
| JP | 2007-081825 | A | 3/2007 |
| JP | 2008-054146 | A | 3/2008 |

(Continued)

OTHER PUBLICATIONS

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

(Continued)

*Primary Examiner* — Jessica Han
*Assistant Examiner* — Michael Bouizza

(57) ABSTRACT

Modulation patterns for surface scattering antennas provide desired antenna pattern attributes such as reduced side lobes and reduced grating lobes.

44 Claims, 6 Drawing Sheets

(56) References Cited

U.S. PATENT DOCUMENTS

| | | | |
|---|---|---|---|
| 5,512,906 | A | 4/1996 | Speciale |
| 6,061,023 | A | 5/2000 | Daniel et al. |
| 6,075,483 | A | 6/2000 | Gross |
| 6,084,540 | A | 7/2000 | Yu |
| 6,114,834 | A | 9/2000 | Parise |
| 6,166,690 | A | 12/2000 | Lin et al. |
| 6,211,823 | B1 | 4/2001 | Herring |
| 6,232,931 | B1 | 5/2001 | Hart |
| 6,366,254 | B1 | 4/2002 | Sievenpiper et al. |
| 6,384,797 | B1 | 5/2002 | Schaffner et al. |
| 6,469,672 | B1 | 10/2002 | Marti-Canales et al. |
| 6,552,696 | B1 | 4/2003 | Sievenpiper et al. |
| 6,633,026 | B2 | 10/2003 | Tuominen |
| 7,068,234 | B2 | 6/2006 | Sievenpiper |
| 7,151,499 | B2 | 12/2006 | Avakian et al. |
| 7,154,451 | B1 | 12/2006 | Sievenpiper |
| 7,253,780 | B2 | 8/2007 | Sievenpiper |
| 7,307,596 | B1 | 12/2007 | West |
| 7,456,787 | B2 | 11/2008 | Manasson et al. |
| 7,609,223 | B2 | 10/2009 | Manasson et al. |
| 7,667,660 | B2 | 2/2010 | Manasson et al. |
| 7,830,310 | B1 | 11/2010 | Sievenpiper et al. |
| 7,864,112 | B2 | 1/2011 | Manasson et al. |
| 7,911,407 | B1 | 3/2011 | Fong et al. |
| 7,995,000 | B2 | 8/2011 | Manasson et al. |
| 8,040,586 | B2 | 10/2011 | Smith et al. |
| 8,059,051 | B2 | 11/2011 | Manasson et al. |
| 8,134,521 | B2 | 3/2012 | Herz et al. |
| 8,179,331 | B1 | 5/2012 | Sievenpiper |
| 8,212,739 | B2 | 7/2012 | Sievenpiper |
| 8,339,320 | B2 | 12/2012 | Sievenpiper |
| 8,456,360 | B2 | 6/2013 | Manasson et al. |
| 2002/0167456 | A1 | 11/2002 | McKinzie, III |
| 2003/0214443 | A1 | 11/2003 | Bauregger et al. |
| 2004/0227668 | A1 | 11/2004 | Sievenpiper |
| 2004/0263408 | A1 | 12/2004 | Sievenpiper et al. |
| 2005/0031016 | A1* | 2/2005 | Rosen ..... H04B 1/713 375/130 |
| 2005/0031295 | A1 | 2/2005 | Engheta et al. |
| 2005/0041746 | A1* | 2/2005 | Rosen ..... H04B 1/7163 375/242 |
| 2006/0065856 | A1 | 3/2006 | Diaz et al. |
| 2006/0114170 | A1 | 6/2006 | Sievenpiper |
| 2006/0116097 | A1 | 6/2006 | Thompson |
| 2007/0085757 | A1 | 4/2007 | Sievenpiper |
| 2007/0159395 | A1 | 7/2007 | Sievenpiper et al. |
| 2007/0159396 | A1 | 7/2007 | Sievenpiper et al. |
| 2007/0182639 | A1 | 8/2007 | Sievenpiper et al. |
| 2007/0200781 | A1 | 8/2007 | Ahn et al. |
| 2008/0180339 | A1 | 7/2008 | Yagi |
| 2008/0224707 | A1 | 9/2008 | Wisler et al. |
| 2008/0268790 | A1 | 10/2008 | Shi et al. |
| 2008/0316088 | A1 | 12/2008 | Pavlov et al. |
| 2009/0002240 | A1 | 1/2009 | Sievenpiper et al. |
| 2009/0109121 | A1 | 4/2009 | Herz et al. |
| 2009/0251385 | A1 | 10/2009 | Xu et al. |
| 2010/0066629 | A1 | 3/2010 | Sievenpiper |
| 2010/0073261 | A1 | 3/2010 | Sievenpiper |
| 2010/0134370 | A1 | 6/2010 | Oh et al. |
| 2010/0156573 | A1 | 6/2010 | Smith et al. |
| 2010/0188171 | A1 | 7/2010 | Mohajer-Iravani et al. |
| 2010/0238529 | A1* | 9/2010 | Sampsell ..... G02B 5/32 359/15 |
| 2010/0279751 | A1 | 11/2010 | Pourseyed et al. |
| 2010/0328142 | A1 | 12/2010 | Zoughi et al. |
| 2011/0151789 | A1 | 6/2011 | Viglione et al. |
| 2011/0267664 | A1 | 11/2011 | Kitamura et al. |
| 2012/0026068 | A1 | 2/2012 | Sievenpiper |
| 2012/0194399 | A1 | 8/2012 | Bily et al. |
| 2012/0268340 | A1 | 10/2012 | Capozzoli et al. |
| 2013/0069865 | A1 | 3/2013 | Hart |
| 2013/0249310 | A1 | 9/2013 | Hyde et al. |
| 2013/0278211 | A1 | 10/2013 | Cook et al. |
| 2014/0266946 | A1 | 9/2014 | Bily et al. |

FOREIGN PATENT DOCUMENTS

| | | | |
|---|---|---|---|
| JP | 2010-187141 | A | 8/2010 |
| KR | 10-1045585 | B1 | 6/2011 |
| WO | WO 2008-007545 | A1 | 1/2008 |
| WO | WO 2008/059292 | A2 | 5/2008 |
| WO | WO 2009/103042 | A2 | 8/2009 |
| WO | WO 2010/021736 | | 2/2010 |
| WO | PCT/US2013/212504 | | 5/2013 |
| WO | WO 2013/147470 | A1 | 10/2013 |

OTHER PUBLICATIONS

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494: Hindawi Publishing Corporation.

"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.

Belloni, Fabio; "Channel Sounding"; S-72.4210 PG Course in Radio Communications; Bearing a date of Feb. 7, 2006; pp. 1-25.

Chen, Robert; *Liquid Crystal Displays*, Wiley, New Jersey 2011 (not provided).

Chin, J.Y. et al.; "An efficient broadband metamaterial wave retarder"; Optics Express; vol. 17, No. 9; p. 7640-7647; 2009.

Chu, R. S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.

Colburn et al.; "Adaptive Artificial Impedance Surface Conformal Antennas"; in Proc. IEEE Antennas and Propagation Society Int. Symp.; 2009; p. 1-4.

Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.

Den Boer, Wilem; *Active Matrix Liquid Crystal Displays*; Elsevier, Burlington, MA, 2009 (not provided).

Diaz, Rudy; "Fundamentals of EM Waves"; Bearing a date of Apr. 4, 2013; 6 total pages, located at: http://www.microwaves101.com/encycolpedia/absorbingradar1.cfm.

Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.

Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.

European Patent Office, Supplementary European Search Report, pursuant to Rule 62 EPC; App. No. EP 11 83 2873; May 15, 2014 (received by our Agent on May 21, 2014); 7 pages.

Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.

Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.

Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.

Frenzel, Lou; "What's the Difference Between EM Near Field and Far Field?"; Electronic Design; Bearing a date of Jun. 8, 2012; 7 total pages; located at: http://electronicdesign.com/energy/what-s-difference-between-em-field-and-far-field.

Grbic, Anthony; "Electrical Engineering and Computer Science"; University of Michigan; Create on Mar. 18, 2014, printed on Jan. 27, 2014; pp. 1-2; located at http;//sitemaker.umich.edu/agrbic/projects.

Grbic et al.; "Metamaterial Surfaces for Near and Far-Field Appli-

(56) References Cited

OTHER PUBLICATIONS cations"; 7th European Conference on Antennas and Propagation (EUCAP 2013); Bearing a date of 2013, Created on Mar. 18, 2014; pp. 1-5.
Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.
Imani et al.; "A Concentrically Corrugated Near-Field Plate"; Bearing a date of 2010; Created on Mar. 18, 2014; pp. 1-4; IEEE.
Imani et al.; "Design of a Planar Near-Field Plate"; Bearing at date of 2012, Created on Mar. 18, 2014; pp. 102, IEEE.
Imani et al.; "Planar Near-Field Plates"; Bearing a date of 2013, Create on Mar. 18, 2014; pp. 1-10; IEEE.
Islam et al.; "A Wireless Channel Sounding System for Rapid Propagation Measurements"; Bearing a date of Nov. 21, 2012, 7 total pages.
Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.
Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.
Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.
Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.
Konishi, Yohei; "Channel Sounding Technique Using MIMO Software Radio Architecture"; 12th MCRG Joint Seminar: Bearing a date of Nov. 18, 2010; 28 total pages.
Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Lipworth et al.; "Magnetic Metamaterial Superlens for Increase Range Wireless Power Transfer"; Scientific Reports; Bearing a date of Jan. 101, 2014; pp. 1-6; vol. 4, No. 3642.
Luo et al.; "Hig-directivity antenna with small antenna aperture"; Applied Physics Letters; 2009; pp. 193506-1-193506-3; vol. 95; American Institute of Physics.
Manasson et al.; "Electronically Reconfigurable Aperture (ERA): A New Approach for Beam-Steering Technology"; Bearing dates of Oct. 12-15, 2010; pp. 673-679; IEEE.
McLean et al.; "Interpreting Antenna Performance Parameters for EMC Applications: Part 2: Radiation Patter, Gain, and Directivity"; Created on Apr. 1, 2014; pp. 7-17; TDK RF Solutions Inc.
Mitri, F.G.; "Quasi-Gaussian Electromagnetic Beams"; Physical Review A.; Bearing a date of Mar. 11, 2013; p. 1; vol. 87, No. 035804; (Abstract Only).
Ovi et al.; "Symmetrical Slot Loading in Elliptical Microstrip Patch antennas Partially Filled with Mue Negative Metamaterials"; PIERS Proceedings, Moscow, Russia; Aug. 19-23, 2012; pp. 542-545.
Patel, Hasmukh S. et al.; "Generalized Techniques of Harmonic Elimination and Voltage Control in Thyristor Inverters: Part I—Harmonic Elimination"; IEEE Transaction on Industry Applications; vol. IA-9, No. 3, May/Jun. 1973; pp. 310-317; IEEE.
PCT International Search Report; International App. No. PCT/US2014/017454; Aug. 28, 2014; pp. 1-4.
PCT International Search Report; International App. No. PCT/US2011/001755; Mar. 22, 2012; pp. 1-5.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
"Satellite Navigation"; Crosslink; The Aerospace Corporation magazine of advances in aerospace technology; Summer 2002; vol. 3, No. 2; pp. 1-56; The Aerospace Corporation.
Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Siciliano et al.; "25. Multisensor Data Fusion"; Springer Handbook of Robotics; Bearing a date of 2008, Created on Mar. 18, 2014; 27 total pages; Springer.
Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Smith, David R.; "Recent Progress in Metamaterial and Transformation Optical Design"; NAVAIR Nano/Meta Workshop; Feb. 2-3, 2011; pp. 1-32.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 total pages; Fulton Innovation LLC.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Wallace, John; "Flat 'Metasurface' Becomes Aberration-Free Lens"; Bearoing a date of Aug. 28, 2012; 4 total pages; located at: http://www.laserfocusworld.com/articles/2012/08/flat-metasurface-becomes-aberration-free-lens.html.
"Wavenumber"; Microwave Encyclopedia; bearing a date of Jan. 12, 2008; pp. 1-2 P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Yoon et al.; "Realizing Efficient Wireless Power Transfer in the Near-Field Region Using Electrically small Antennas"; Wireless

(56) References Cited

OTHER PUBLICATIONS

Power Transfer; Principles and Engineering Explorations: Bearing a date of Jan. 25, 2012; pp. 151-172.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Intellectual Property Office of Singapore Examination Report; Application No. 2013027842; Feb. 27, 2015; (received by our Agent on Apr. 28, 2015); pp. 1-12.
Jiao, Yong-Chang et al.; A New Low-Side-Lobe Pattern Synthesis Technique for Conformal Arrays; IEEE Transactions on Antennas and Propagation; Jun. 1993; pp. 824-831; vol. 41, No. 6; IEEE.
Patent Office of the Russian Federation (Rospatent) Office Action; Application No. 2013119332/28(028599); Oct. 13, 2015 (received by our Agent on Oct. 23, 2015); machine translation; pp. 1-5.
PCT International Search Report; International App. No. PCT/US2014/069254; Nov. 27, 2015; pp. 1-4.
PCT International Search Report; International App. No. PCT/US2015/036638; Oct. 19, 2015; pp. 1-4.
PCT International Search Report; International App. No. PCT/US2015/028781; Jul. 27, 2015; pp. 1-3.
PCT International Search Report; International App. No. PCT/US2014/070645; Mar. 16, 2015; pp. 1-3.
PCT International Search Report; International App. No. PCT/US2014/070650; Mar. 27, 2015; pp. 1-3.
PCT International Search Report; International App. No. PCT/US2014/061485; Oct. 21, 2014; pp. 1-3.
The State Intellectual Property Office of P.R. C.; Application No. 201180055705.8; Nov. 4, 2015; (received by our Agent on Nov. 10, 2015); pp. 1-11.
The State Intellectual Property Office of P.R. C.; Application No. 201180055705.8; May 6, 2015; (received by our Agent on May 11, 2015); pp. 1-11.

* cited by examiner

FIG. 5A
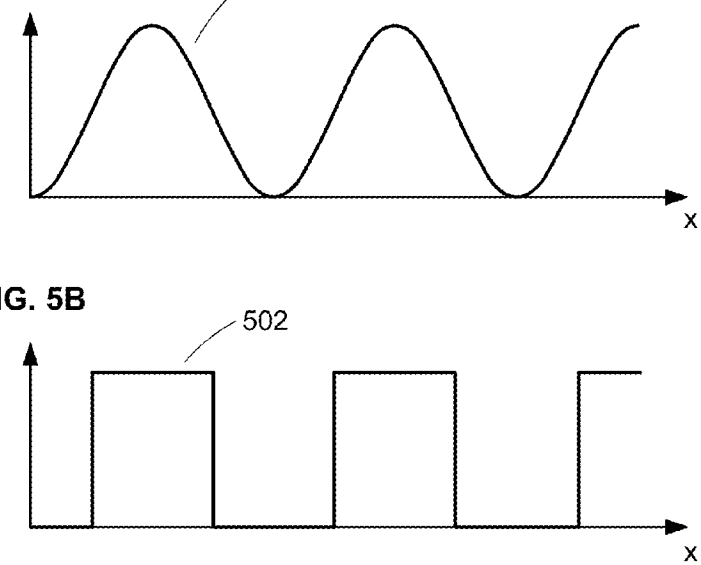
FIG. 5B
FIG. 5C
FIG. 5D
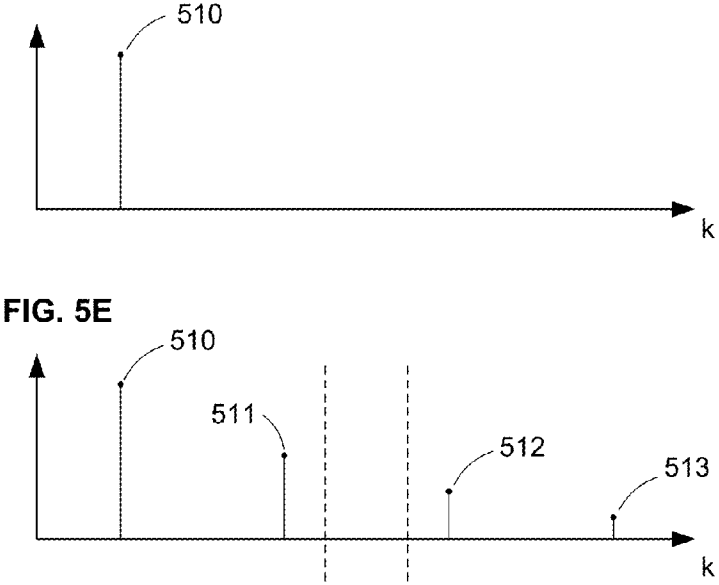
FIG. 5E
FIG. 5F

MODULATION PATTERNS FOR SURFACE SCATTERING ANTENNAS

CROSS-REFERENCE TO RELATED APPLICATIONS

The present application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

The present application constitutes a continuation-in-part of U.S. patent application Ser. No. 14/510,947, entitled MODULATION PATTERNS FOR SURFACE SCATTERING ANTENNAS, naming Pai-Yen Chen, Tom Driscoll, Siamak Ebadi, John Desmond Hunt, Nathan Ingle Landy, Melroy Machado, Milton Perque, Jr., David R. Smith, and Yaroslav A. Urzhumov as inventors, filed 9 Oct. 2014, which is currently co-pending or is an application of which a currently co-pending application is entitled to the benefit of the filing date.

The present application constitutes a continuation-in-part of U.S. patent application Ser. No. 14/549,928, entitled MODULATION PATTERNS FOR SURFACE SCATTERING ANTENNAS, naming Pai-Yen Chen, Tom Driscoll, Siamak Ebadi, John Desmond Hunt, Nathan Ingle Landy, Melroy Machado, Milton Perque, Jr., David R. Smith, and Yaroslav A. Urzhumov as inventors, filed 21 Nov. 2014, which is currently co-pending or is an application of which a currently co-pending application is entitled to the benefit of the filing date.

U.S. Patent Application No. 61/455,171, entitled SURFACE SCATTERING ANTENNAS, naming NATHAN KUNDTZ ET AL. as inventors, filed Oct. 15, 2010, is related to the present application.

U.S. patent application Ser. No. 13/317,338, entitled SURFACE SCATTERING ANTENNAS, naming ADAM BILY, ANNA K. BOARDMAN, RUSSELL J. HANNIGAN, JOHN HUNT, NATHAN KUNDTZ, DAVID R. NASH, RYAN ALLAN STEVENSON, AND PHILIP A. SULLIVAN as inventors, filed Oct. 14, 2011, is related to the present application.

U.S. patent application Ser. No. 13/838,934, entitled SURFACE SCATTERING ANTENNA IMPROVEMENTS, naming ADAM BILY, JEFF DALLAS, RUSSELL J. HANNIGAN, NATHAN KUNDTZ, DAVID R. NASH, AND RYAN ALLAN STEVEN as inventors, filed Mar. 15, 2013, is related to the present application.

U.S. Patent Application No. 61/988,023, entitled SURFACE SCATTERING ANTENNAS WITH LUMPED ELEMENTS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed May 2, 2014, is related to the present application.

U.S. patent application Ser. No. 14/506,432, entitled SURFACE SCATTERING ANTENNAS WITH LUMPED ELEMENTS, naming PAI-YEN CHEN, TOM DRISCOLL, SIAMAK EBADI, JOHN DESMOND HUNT, NATHAN INGLE LANDY, MELROY MACHADO, JAY MCCANDLESS, MILTON PERQUE, DAVID R. SMITH, AND YAROSLAV A. URZHUMOV as inventors, filed Oct. 3, 2014, is related to the present application.

U.S. Patent Application No. 61/992,699, entitled CURVED SURFACE SCATTERING ANTENNAS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed May 13, 2014, is related to the present application.

The present application claims benefit of priority of U.S. Provisional Patent Application No. 62/015,293, entitled MODULATION PATTERNS FOR SURFACE SCATTERING ANTENNAS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed Jun. 20, 2014, which was filed within the twelve months preceding the filing date of the present application.

All subject matter of all of the above applications is incorporated herein by reference to the extent such subject matter is not inconsistent herewith.

BRIEF DESCRIPTION OF THE FIGURES

FIGS. 5A-5F depict an example of hologram discretization and aliasing.

DETAILED DESCRIPTION

Figure 1:
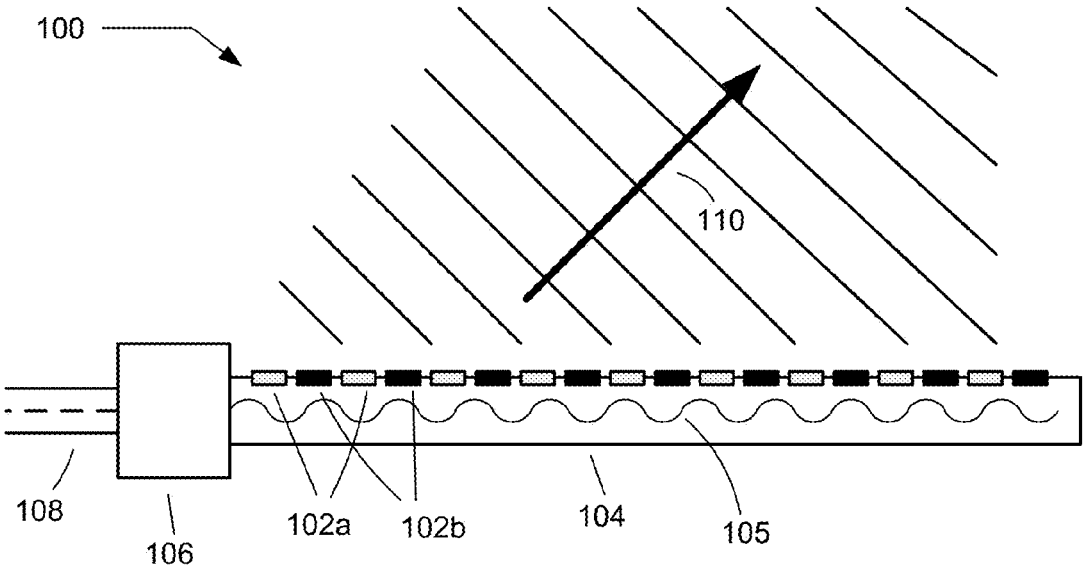
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A schematic illustration of a surface scattering antenna is depicted in FIG. 1. The surface scattering antenna 100 includes a plurality of scattering elements 102*a*, 102*b* that are distributed along a wave-propagating structure 104. The wave propagating structure 104 may be a microstrip, a coplanar waveguide, a parallel plate waveguide, a dielectric rod or slab, a closed or tubular waveguide, a substrate-integrated waveguide, or any other structure capable of supporting the propagation of a guided wave or surface wave 105 along or within the structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). It is also to be noted that while the disclosure herein generally refers to the guided wave or surface wave 105 as a propagating wave, other embodiments are contemplated that make use of a standing wave that is a superposition of an input wave and reflection(s) thereof. The scattering elements 102*a*, 102*b* may include scattering elements that are embedded within, positioned on a surface of, or positioned within an evanescent proximity of, the wave-propagation structure 104. For example, the scattering elements can include complementary metamaterial elements such as those presented in D. R. Smith et al, "Metamaterials for surfaces and waveguides," U.S. Patent Application Publication No. 2010/0156573, and A. Bily et al, "Surface scattering antennas," U.S. Patent Application Publication No. 2012/0194399, each of which is herein incorporated by reference. As another example, the scattering elements can include patch elements such as those presented in A. Bily et al, "Surface scattering antenna improvements," U.S. U.S. patent application Ser. No. 13/838,934, which is herein incorporated by reference.

The surface scattering antenna also includes at least one feed connector 106 that is configured to couple the wave-propagation structure 104 to a feed structure 108. The feed structure 108 (schematically depicted as a coaxial cable) may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include non-linear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi_{in}^*]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to an operating frequency of the device (for example, less than one-third, one-fourth, or one-fifth of this free-space wavelength). In some approaches, the operating frequency is a microwave frequency, selected from frequency bands such as L, S, C, X, Ku, K, Ka, Q, U, V, E, W, F, and D, corresponding to frequencies ranging from about 1 GHz to 170 GHz and free-space wavelengths ranging from millimeters to tens of centimeters. In other approaches, the operating frequency is an RF frequency, for example in the range of about 100 MHz to 1 GHz. In yet other approaches, the operating frequency is a millimeter-wave frequency, for example in the range of about 170 GHz to 300 GHz. These ranges of length scales admit the fabrication of scattering elements using conventional printed circuit board or lithographic technologies.

Figure 2A:
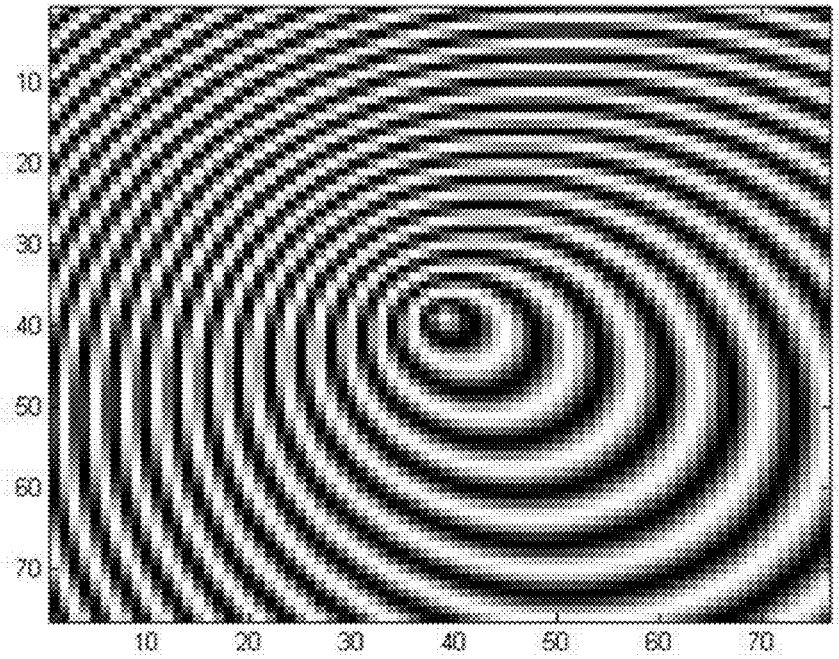
FIGS. 2A and 2B respectively depict an exemplary adjustment pattern and corresponding beam pattern for a surface scattering antenna.
Figure 2B:
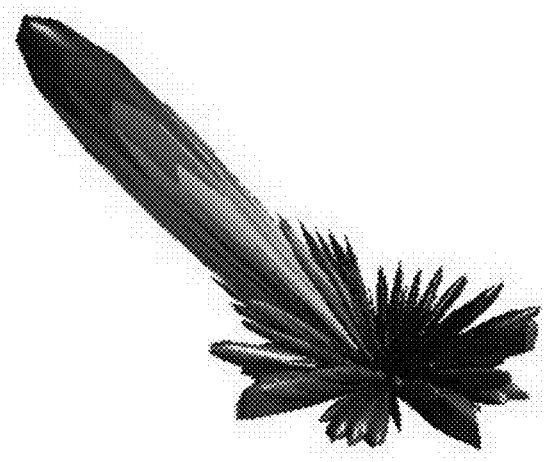
Figure 3A:
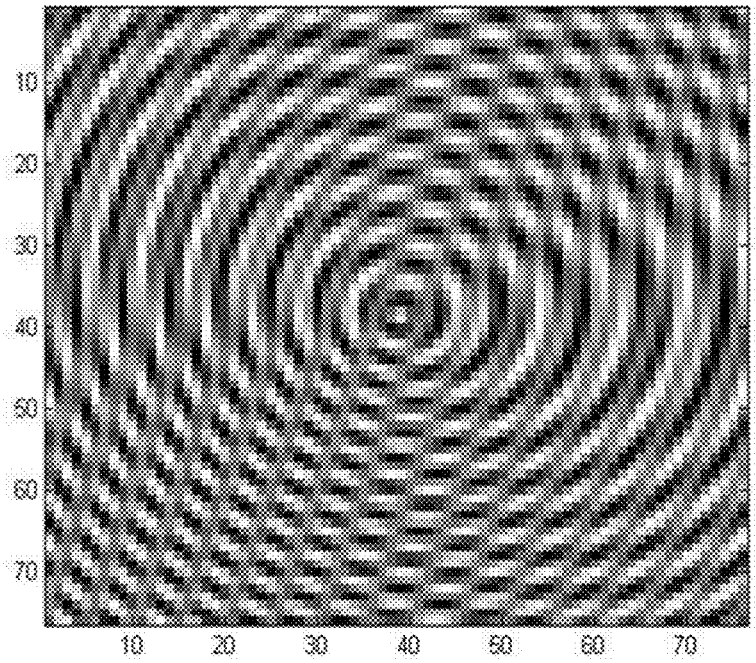
FIGS. 3A and 3B respectively depict another exemplary adjustment pattern and corresponding beam pattern for a surface scattering antenna.
Figure 3B:
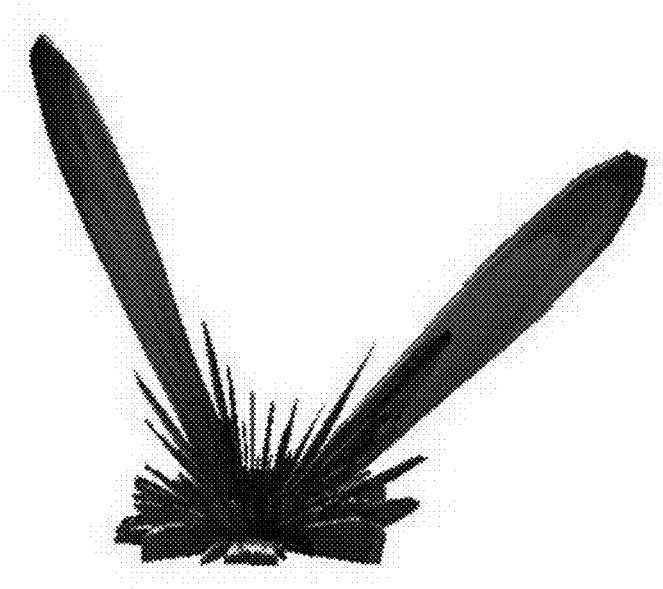
Figure 4A:
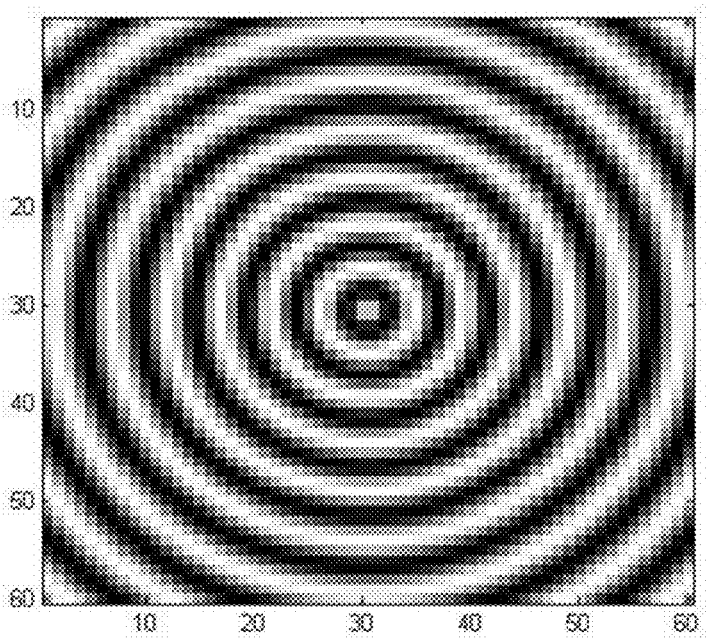
FIGS. 4A and 4B respectively depict another exemplary adjustment pattern and corresponding field pattern for a surface scattering antenna.
Figure 4B:
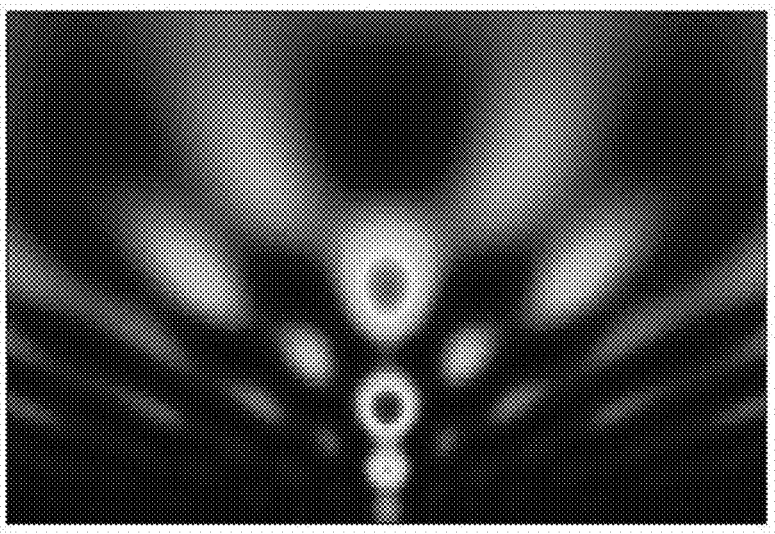

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B. FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. These interdigital arrangements may include a feed connector having a tree structure, e.g. a binary tree providing repeated forks that distribute energy from the feed structure 108 to the plurality of linear structures (or the reverse thereof). As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\phi_j$ to the jth scattering element; subsequently, an output wave is generated as a superposition of waves scattered from the plurality of scattering elements:

$$E(\theta, \phi) = \sum_j R_j(\theta, \phi)\alpha_j A_j e^{i\phi_j} e^{i(k(\theta,\phi)\cdot r_j)}, \quad (1)$$

where $E(\theta,\phi)$ represents the electric field component of the output wave on a far-field radiation sphere, $R_j(\theta,\phi)$ represents a (normalized) electric field pattern for the scattered wave that is generated by the jth scattering element in response to an excitation caused by the coupling $\alpha_j$, and $k(\theta,\phi)$ represents a wave vector of magnitude $\omega/c$ that is perpendicular to the radiation sphere at $(\theta,\phi)$. Thus, embodiments of the surface scattering antenna may provide a reconfigurable antenna that is adjustable to produce a desired output wave $E(\theta,\phi)$ by adjusting the plurality of couplings $\{\alpha_j\}$ in accordance with equation (1).

The wave amplitude $A_j$ and phase $\omega_j$ of the guided wave or surface wave are functions of the propagation characteristics of the wave-propagating structure 104. Thus, for example, the amplitude $A_j$ may decay exponentially with distance along the wave-propagating structure, $A_j \sim A_0 \exp(-\kappa x_j)$, and the phase $\omega_j$ may advance linearly with distance along the wave-propagating structure, $\omega_j \sim \phi_0 + \beta x_j$, where $\kappa$ is a decay constant for the wave-propagating structure, $\beta$ is a propagation constant (wavenumber) for the wave-propagating structure, and $x_j$ is a distance of the jth scattering element along the wave-propagating structure. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\phi_j$ of the guided wave or surface wave may depend upon the adjustable scattering element couplings $\{\alpha_j\}$ (i.e. $A_i = A_i(\{\alpha_j\})$, $\phi_i = \phi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta,\phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta,\phi)$ may be expressed as a sum of two linearly polarized components:

$$E(\theta,\phi) = E^{(1)}(\theta,\phi) + E^{(2)}(\theta,\phi) = \Lambda^{(1)}R^{(1)}(\theta,\phi) + \Lambda^{(2)}R^{(2)}(\theta,\phi), \tag{2}$$

where $$\Lambda^{(1,2)}(\theta,\phi) = \sum_{j \in LP^{(1,2)}} \alpha_j A_j e^{i\varphi_j} e^{i[k(\theta,\phi)\cdot r_j]} \tag{3}$$

are the complex amplitudes of the two linearly polarized components. Accordingly, the polarization of the output wave $E(\theta,\phi)$ may be controlled by adjusting the plurality of couplings $\{\alpha_j\}$ in accordance with equations (2)-(3), e.g. to provide an output wave with any desired polarization (e.g. linear, circular, or elliptical).

Alternatively or additionally, for embodiments in which the wave-propagating structure has a plurality of feeds (e.g. one feed for each "finger" of an interdigital arrangement of one-dimensional wave-propagating structures, as discussed above), a desired output wave $E(\theta,\phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Turning now to a consideration of modulation patterns for surface scattering antennas: recall, as discussed above, that the guided wave or surface wave may be represented by a complex scalar input wave $\Psi_{in}$ that is a function of position along the wave-propagating structure. To produce an output wave that may be represented by another complex scalar wave $\Psi_{out}$, a pattern of adjustments of the scattering elements may be selected that corresponds to an interference pattern of the input and output waves along the wave-propagating structure. For example, the scattering elements may be adjusted to provide couplings to the guided wave or surface wave that are functions of a complex continuous hologram function $h = \Psi_{out}\Psi_{in}^*$.

In some approaches, the scattering elements can be adjusted only to approximate the ideal complex continuous hologram function $h = \Psi_{out}\Psi_{in}^*$. For example, because the scattering elements are positioned at discrete locations along the wave-propagating structure, the hologram function must be discretized. Furthermore, in some approaches, the set of possible couplings between a particular scattering elements and the waveguide is a restricted set of couplings; for example, an embodiment may provide only a finite set of possible couplings (e.g. a "binary" or "on-off" scenario in which there are only two available couplings for each scattering element, or a "grayscale" scenario in which there are N available couplings for each scattering element); and/or the relationship between the amplitude and phase of each coupling may be constrained (e.g. by a Lorentzian-type resonance response function). Thus, in some approaches, the ideal complex continuous hologram function is approximated by an actual modulation function defined on a discrete-valued domain (for the discrete positions of the scattering elements) and having a discrete-valued range (for the discrete available tunable settings of the scattering elements).

Consider, for example, a one-dimensional surface scattering antenna on which it is desired to impose an ideal hologram function defined as a simple sinusoid corresponding to a single wavevector (the following disclosure, relating to the one-dimensional sinusoid, is not intended to be limiting and the approaches set forth are applicable to other two-dimensional hologram patterns). Various discrete modulation functions may be used to approximate this ideal hologram function. In a "binary" scenario where only two values of individual scattering element coupling are available, one approach is to apply a Heaviside function to the sinusoid, creating a simple square wave. Regardless of the density of scattering elements, that Heaviside function will have approximately half the cells on and half off, in a steady repeating pattern. Unlike the spectrally pure sinusoid though, a square wave contains an (infinite) series of higher harmonics. In these approaches, the antenna may be designed so that the higher harmonics correspond to evanescent waves, making them non-radiating, but their aliases do still map into non-evanescent waves and radiate as grating lobes.

An illustrative example of the discretization and aliasing effect is shown in FIGS. 5A-5F. FIG. 5A depicts a continuous hologram function that is a simple sinusoid 500; in Fourier space, this is represented as a single Fourier mode 510 as shown in FIG. 5D. When the Heaviside function is applied to the sinusoid, the result is a square wave 502 as shown in FIG. 5B; in Fourier space, the square wave includes the fundamental Fourier mode 510 and an (infinite) series of higher harmonics 511, 512, 513, etc. as shown in FIG. 5E. Finally, when the square wave is sampled at a discrete set of locations corresponding to the discrete locations of the scattering elements, the result is a discrete-valued function 504 on a discrete domain, as shown in FIG. 5C (here assuming a lattice constant a).

The sampling of the square wave at a discrete set of locations leads to an aliasing effect in Fourier space, as shown in FIG. 5F. In this illustration, the sampling with a lattice constant a leads to a "folding" of the Fourier spectrum around the Nyquist spatial frequency $\pi/a$, creating aliases 522 and 523 for the original harmonics 512 and 513, respectively. Supposing that the aperture has an evanescent cutoff given by $2\pi f/c$ as shown (where f is an operating frequency of the antenna and c is the speed of light in an ambient medium surrounding the antenna, which can be vacuum, air, a dielectric material, etc.), one of the harmonics (513) is aliased into the non-evanescent spatial frequency range (523) and can radiate as a grating lobe. Note that in this example, the first harmonic 511 is unaliased but also within the non-evanescent spatial frequency range, so it can generate another undesirable side lobe The Heaviside function is not the only choice for a binary hologram, and other choices may eliminate, average, or otherwise mitigate the higher harmonics and the resulting side/grating lobes. A useful way to view these approaches is as attempting to "smooth" or "blur" the sharp corners in the Heaviside without resorting to values other than 0 and 1. For example, the single step of the Heaviside function may be replaced by a function that resembles a pulse-width-modulated (PWM) square wave with a duty cycle that gradually increases from 0 to 1 over the range of the sinusoid. Alternatively, a probabilistic or dithering approach may be used to determine the settings of the individual scattering elements, for example by randomly adjusting each scattering element to the "on" or "off" state according to a probability that gradually increases from 0 to 1 over the range of the sinusoid.

In some approaches, the binary approximation of the hologram may be improved by increasing the density of scattering elements. An increased density results in a larger number of adjustable parameters that can be optimized, and a denser array results in better homogenization of electromagnetic parameters.

Alternatively or additionally, in some approaches the binary approximation of the hologram may be improved by arranging the elements in a non-uniform spatial pattern. If the scattering elements are placed on non-uniform grid, the rigid periodicity of the Heaviside modulation is broken, which spreads out the higher harmonics. The non-uniform spatial pattern can be a random distribution, e.g. with a selected standard deviation and mean, and/or it can be a gradient distribution, with a density of scattering elements that varies with position along the wave-propagating structure. For example, the density may be larger near the center of the aperture to realize an amplitude envelope.

Alternatively or additionally, in some approaches the binary approximation of the hologram may be improved by arranging the scattering elements to have non-uniform nearest neighbor couplings. Jittering these nearest-neighbor couplings can blur the k-harmonics, yielding reduced side/grating lobes. For example, in approaches that use a via fence to reduce coupling or crosstalk between adjacent unit cells, the geometry of the via fence (e.g. the spacing between vias, the sizes of the via holes, or the overall length of the fence) can be varied cell-by-cell. In other approaches that use a via fence to separate the cavities for a series of scattering elements that are cavity-fed slots, again the geometry of the via fence can be varied cell-by-cell. This variation can correspond to a random distribution, e.g. with a selected standard deviation and mean, and/or it can be a gradient distribution, with a nearest-neighbor coupling that varies with position along the wave-propagating structure. For example, the nearest-neighbor coupling may be largest (or smallest) near the center of the aperture.

Alternatively or additionally, in some approaches the binary approximation of the hologram may be improved by increasing the nearest-neighbor couplings between the scattering elements. For example, small parasitic elements can be introduced to act as "blurring pads" between the unit cells. The pad can be designed to have a smaller effect between two cells that are both "on" or both "off," and a larger effect between an "on" cell and an "off" cell, e.g. by radiating with an average of the two adjacent cells to realize a mid-point modulation amplitude.

Alternatively or additionally, in some approaches the binary approximation of the hologram may be improved using error propagation or error diffusion techniques to determine the modulation pattern. An error propagation technique may involve considering the desired value of a pure sinusoid modulation and tracking a cumulative difference between that and the Heaviside (or other discretization function). The error accumulates, and when it reaches a threshold it carries over to the current cell. For a two-dimensional scattering antenna composed of a set of rows, the error propagation may be performed independently on each row; or the error propagation may be performed row-by-row by carrying over an error tally from the end of row to the beginning of the next row; or the error propagation may be performed multiple times along different directions (e.g. first along the rows and then perpendicular to the rows); or the error propagation may use a two-dimensional error propagation kernel as with Floyd-Steinberg or Jarvis-Judice-Ninke error diffusion. For an embodiment using a plurality of one-dimensional waveguides to compose a two-dimensional aperture, the rows for error diffusion can correspond to individual one-dimensional waveguides, or the rows for error diffusion can be oriented perpendicularly to the one-dimensional waveguides. In other approaches, the rows can be defined with respect to the waveguide mode, e.g. by defining the rows as a series of successive phase fronts of the waveguide mode (thus, a center-fed parallel plate waveguide would have "rows" that are concentric circles around the feed point). In yet other approaches, the rows can be selected depending on the hologram function that is being discretized—for example, the rows can be selected as a series of contours of the hologram function, so that the error diffusion proceeds along directions of small variation of the hologram function.

Alternatively or additionally, in some approaches grating lobes can be reduced by using scattering elements with increased directivity. Often the grating lobes appear far from the main beam; if the individual scattering elements are designed to have increased broadside directivity, large-angle aliased grating lobes may be significantly reduced in amplitude.

Alternatively or additionally, in some approaches grating lobes can be reduced by changing the input wave $\Psi_{in}$ along the wave-propagating structure. By changing the input wave throughout a device, the spectral harmonics are varied, and large grating lobes may be avoided. For example, for a two-dimensional scattering antenna composed of a set of parallel one-dimensional rows, the input wave can be changed by alternating feeding directions for successive rows, or by alternating feeding directions for the top and bottom halves of the antenna. As another example, the effective index of propagation along the wave-propagating structure can be varied with position along the wave-propagating structure, by varying some aspect of the wave-propagating structure geometry (e.g. the positions of the vias in a substrate-integrated waveguide), by varying dielectric value (e.g. the filling fraction of a dielectric in a closed waveguide), by actively loading the wave-propagating structure, etc.

Alternatively or additionally, in some approaches the grating lobes can be reduced by introducing structure on top of the surface scattering antenna. For example, a fast-wave structure (such as a dispersive plasmonic or surface wave structure or an air-core-based waveguide structure) placed on top of the surface-scattering antenna can be designed to propagate the evanescent grating lobe and carry it out to a load dump before it aliases into the non-evanescent region. As another example, a directivity-enhancing structure (such as an array of collimating GRIN lenses) can be placed on top of the surface scattering antenna to enhance the individual directivities of the scattering elements.

While some approaches, as discussed above, arrange the scattering elements in a non-uniform spatial pattern, other approaches maintain a uniform arrangement of the scattering elements but vary their "virtual" locations to be used in calculating the modulation pattern. Thus the scattering elements can physically still exist on a uniform grid (or any other fixed physical pattern), but their virtual location is shifted in the computation algorithm. For example, the virtual locations can be determined by applying a random displacement to the physical locations, the random displacement having a zero mean and controllable distribution, analogous to classical dithering. Alternatively, the virtual locations can be calculated by adding a non-random displacement from the physical locations, the displacement varying with position along the wave-propagating structure (e.g. with intentional gradients over various length scales).

In some approaches, undesirable grating lobes can be reduced by flipping individual bits corresponding to individual scattering elements. In these approaches, each element can be described as a single bit which contributes spectrally to both the desired fundamental modulation and to the higher harmonics that give rise to grating lobes. Thus, single bits that contribute to harmonics more than the fundamental can be flipped, reducing the total harmonics level while leaving the fundamental relatively unaffected.

Alternatively or additionally, undesirable grating lobes can be reduced by applying a spectrum (in k-space) of modulation fundamentals rather than a single fundamental, i.e. range of modulation wavevectors, to disperse energy put into higher harmonics. This is a form of modulation dithering. Because higher harmonics pick up an additional $2\pi$ wave-vector phase when they alias back into the visible, grating lobes resulting from different modulation wavevectors can be spread in radiative angle even while the main beams overlap. This spectrum of modulation wavevectors can be flat, Gaussian, or any other distribution across a modulation wavevector bandwidth.

Alternatively or additionally, undesirable grating lobes can be reduced by "chopping" the range-discretized hologram (e.g. after applying the Heaviside function but before sampling at the discrete set of scattering element locations) to selectively reduce or eliminate higher harmonics. Selective elimination of square wave harmonics is described, for example, in H. S. Patel and R. G. Hoft, "Generalized Techniques of Harmonic Elimination and Voltage Control in Thyristor Inverters: Part I—Harmonic Elimination," IEEE Trans. Ind. App. Vol. IA-9, 310 (1973), herein incorporated by reference. For example, the square wave 502 of FIG. 5B can be modified with "chops" that eliminate the harmonics 511 and 513 (as shown in FIG. 5E) so that neither the harmonic 511 nor the aliased harmonic 531 (as shown in FIG. 5F) will generate grating lobes.

Alternatively or additionally, undesirable grating lobes may be reduced by adjusting the wavevector of the modulation pattern. Adjusting the wavevector of the modulation pattern shifts the primary beam, but shifts grating lobes coming from aliased beams to a greater degree (due to the additional $2\pi$ phase shift on every alias). Adjustment of the phase and wavevector of the applied modulation pattern can be used to intentionally form constructive and destructive interference of the grating lobes, side lobes, and main beam. Thus, allowing very minor changes in the angle and phase of the main radiated beam can grant a large parameter space in which to optimize/minimize grating lobes.

Alternatively or additionally, the antenna modulation pattern can be selected according to an optimization algorithm that optimizes a particular cost function. For example, the modulation pattern may be calculated to optimize: realized gain (maximum total intensity in the main beam); relative minimization of the highest side lobe or grating lobe relative to main beam; minimization of main-beam FWHM (beam width); or maximization of main-beam directivity (height above all integrated side lobes and grating lobes); or any combination thereof (e.g. by using a collective cost function that is a weighted sum of individual cost functions, or by selecting a Pareto optimum of individual cost functions). The optimization can be either global (searching the entire space of antenna configurations to optimize the cost function) or local (starting from an initial guess and applying an optimization algorithm to find a local extremum of the cost function).

Various optimization algorithms may be utilized to perform the optimization of the desired cost function. For example, the optimization may proceed using discrete optimization variables corresponding to the discrete adjustment states of the scattering elements, or the optimization may proceed using continuous optimization variables that can be mapped to the discrete adjustment states by a smoothed step function (e.g. a smoothed Heaviside function for a binary antenna or a smoothed sequential stair-step function for a grayscale antenna). Other optimization approaches can include optimization with a genetic optimization algorithm or a simulated annealing optimization algorithm.

The optimization algorithm can involve an iterative process that includes identifying a trial antenna configuration, calculating a gradient of the cost function for the antenna configuration, and then selecting a subsequent trial configuration, repeating the process until some termination condition is met. The gradient can be calculated by, for example, calculating finite-difference estimates of the partial derivatives of the cost function with respect to the individual optimization variables. For N scattering elements, this might involve performing N full-wave simulations, or performing N measurements of a test antenna in a test environment (e.g. an anechoic chamber). Alternatively, the gradient may be calculable by an adjoint sensitivity method that entails solving a single adjoint problem instead of N finite-difference problems; adjoint sensitivity models are available in conventional numerical software packages such as HFSS or CST Microwave Studio. Once the gradient is obtained, a subsequent trial configuration can be calculated using various optimization iteration approaches such as quasi-Newton methods or conjugate gradient methods. The iterative process may terminate, for example, when the norm of the cost function gradient becomes sufficiently small, or when the cost function reaches a satisfactory minimum (or maximum).

In some approaches, the optimization can be performed on a reduced set of modulation patterns. For example, for a binary (grayscale) antenna with N scattering elements, there are $2^N$ (or $g^N$, for g grayscale levels) possible modulation patterns, but the optimization may be constrained to consider only those modulation patterns that yield a desired primary spectral content in the output wave $\Psi_{out}$, and/or the optimization may be constrained to consider only those modulation patterns which have a spatial on-off fraction within a known range relevant for the design.

While the above discussion of modulation patterns has focused on binary embodiments of the surface scattering antenna, it will be appreciated that all of the various approaches described above are directly applicable to grayscale approaches where the individual scattering elements are adjustable between more than two configurations.

Figure 6:
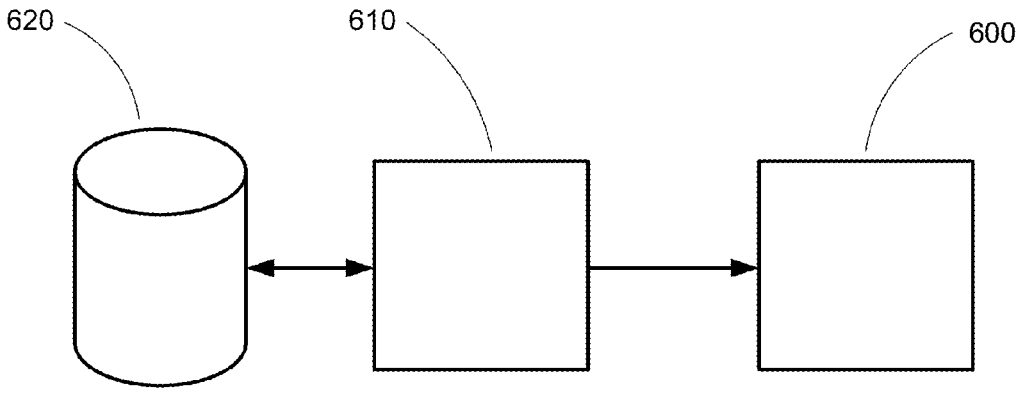
FIG. 6 depicts a system block diagram.

With reference now to FIG. 6, an illustrative embodiment is depicted as a system block diagram. The system includes a surface scattering antenna 600 coupled to control circuitry 610 operable to adjust the surface scattering to any particular antenna configuration. The system optionally includes a storage medium 620 on which is written a set of pre-calculated antenna configurations. For example, the storage medium may include a look-up table of antenna configurations indexed by some relevant operational parameter of the antenna, such as beam direction, each stored antenna configuration being previously calculated according to one or more of the approaches described above. Then, the control circuitry 610 would be operable to read an antenna configuration from the storage medium and adjust the antenna to the selected, previously-calculated antenna configuration. Alternatively, the control circuitry 610 may include circuitry operable to calculate an antenna configuration according to one or more of the approaches described above, and then to adjust the antenna for the presently-calculated antenna configuration.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method, comprising:

discretizing a hologram function for a surface scattering antenna that defines an aperture, where the discretizing includes identifying a discrete plurality of locations on the aperture for a discrete plurality of scattering elements of the surface scattering antenna and identifying a discrete set of states for each of the scattering elements corresponding to a discrete set of function values at each of the locations of the scattering elements; and identifying an antenna configuration that reduces artifacts attributable to the discretizing, wherein the identifying of the antenna configuration includes applying an error diffusion algorithm to the discretized hologram function.

2. The method of claim 1, further comprising:

adjusting the surface scattering antenna to the identified antenna configuration.

3. The method of claim 1, further comprising:

operating the surface scattering antenna in the identified antenna configuration.

4. The method of claim 1, further comprising:

storing the identified antenna configuration in a storage medium.

5. The method of claim 1, wherein the plurality of locations is a sequence of locations, and the applying of the error diffusion algorithm includes, for each location in the sequence of locations:

identifying an error, if any, accumulated at the location from one or more locations earlier in the sequence of locations;

selecting a function value from the discrete set of function values, the selected value being that value in the discrete set of function values that is closest to a sum of the hologram function evaluated at the location and the accumulated error;

identifying a new error equal to the selected function value minus the sum of the hologram function evaluated at the location and the accumulated error; and accumulating the new error at one or more locations, if any, later in the sequence of locations.

6. The method of claim 5, wherein the plurality of scattering elements is a one-dimensional plurality of scattering elements, and the sequence of locations is a sequence of locations of adjacent scattering elements.

7. The method of claim 6, wherein the accumulating of the new error at one or more locations later in the sequence of locations is an accumulating of the new error at a next location in the sequence of locations.

8. The method of claim 5, wherein the plurality of scattering elements is a two-dimensional plurality of scattering elements.

9. The method of claim 8, wherein the two-dimensional plurality of scattering elements is arranged in rows, and the sequence of locations is a row-by-row sequence of locations of adjacent scattering elements in each row.

10. The method of claim 9, wherein the accumulating of the new error at one or more locations later in the sequence of locations is an accumulating of the new error at a next location in the sequence of locations.

11. The method of claim 10, wherein:

if the location is at an end of one of the rows of scattering elements, the accumulating of the new error at the next location in the sequence locations is an accumulating of zero error at the next location in the sequence of locations.

12. The method of claim 9, wherein the accumulating of the new error at one or more locations in the sequence of locations is an accumulating of the new error at multiple locations in a two-dimensional neighborhood of the location.

13. The method of claim 9, wherein the surface scattering antenna includes a plurality of one-dimensional waveguides supporting the two-dimensional plurality of scattering elements, and the rows coincide with the plurality of one-dimensional waveguides.

14. The method of claim 9, wherein the surface scattering antenna includes a plurality of one-dimensional waveguides supporting the two-dimensional plurality of scattering elements, and the rows are perpendicular to the plurality of one-dimensional waveguides.

15. The method of claim 9, wherein the surface scattering antenna includes a waveguide supporting a waveguide mode, and the rows correspond to a set of constant phase fronts of the waveguide mode.

16. The method of claim 9, wherein the rows correspond to a set of contours of the hologram function.

17. The method of claim 5, wherein the identifying of the antenna configuration includes, for each scattering element in the plurality of scattering elements:

identifying a state for the scattering element selected from the discrete set of states and corresponding to the selected function value for the location of the scattering element.

18. A system, comprising:

a surface scattering antenna with a plurality of adjustable scattering elements that are adjustable between a discrete set of states corresponding to a discrete set of function values at each location in a plurality of locations for the plurality of adjustable scattering elements;

a storage medium on which a set of antenna configurations corresponding to a set of hologram functions is written, each antenna configuration being selected to reduce artifacts attributable to a discretization of the respective hologram function; and control circuitry operable to read antenna configurations from the storage medium and adjust the plurality of adjustable scattering elements to provide the antenna configurations;

wherein at least one antenna configuration is an error-propagated discretization of the respective hologram function.

19. The system of claim 18, wherein the error-propagated discretization is obtained by an algorithm that includes, for each location in a sequence of the plurality of locations:

identifying an error, if any, accumulated at the location from one or more locations earlier in the sequence of locations;

selecting a function value from the discrete set of function values, the selected value being that value in the discrete set of function values that is closest to a sum of the respective hologram function evaluated at the location and the accumulated error;

identifying a state for the adjustable scattering element at the location, the identified state being selected from the discrete set of states and corresponding to the selected function value for the location;

identifying a new error equal to the selected function value minus the sum of the respective hologram function evaluated at the location and the accumulated error; and accumulating the new error at one or more locations, if any, later in the sequence of locations.

20. The system of claim 19, wherein the plurality of adjustable scattering elements is a one-dimensional plurality of adjustable scattering elements, and the sequence of locations is a sequence of locations of adjacent scattering elements.

21. The system of claim 20, wherein the accumulating of the new error at one or more locations later in the sequence of locations is an accumulating of the new error at a next location in the sequence of locations.

22. The system of claim 19, wherein the plurality of adjustable scattering elements is a two-dimensional plurality of adjustable scattering elements.

23. The system of claim 22, wherein the two-dimensional plurality of adjustable scattering elements is arranged in rows, and the sequence of locations is a row-by-row sequence of locations of adjacent scattering elements in each row.

24. The system of claim 23, wherein the accumulating of the new error at one or more locations later in the sequence of locations is an accumulating of the new error at a next location in the sequence of locations.

25. The system of claim 24, wherein:

if the location is at an end of one of the rows of scattering elements, the accumulating of the new error at the next location in the sequence locations is an accumulating of zero error at the next location in the sequence of locations.

26. The system of claim 23, wherein the accumulating of the new error at one or more locations in the sequence of locations is an accumulating of the new error at multiple locations in a two-dimensional neighborhood of the location.

27. The system of claim 23, wherein the surface scattering antenna includes a plurality of one-dimensional waveguides supporting the two-dimensional plurality of adjustable scattering elements, and the rows coincide with the plurality of one-dimensional waveguides.

28. The system of claim 23, wherein the surface scattering antenna includes a plurality of one-dimensional waveguides supporting the two-dimensional plurality of adjustable scattering elements, and the rows are perpendicular to the plurality of one-dimensional waveguides.

29. The system of claim 23, wherein the surface scattering antenna includes a waveguide supporting a waveguide mode, and the rows correspond to a set of constant phase fronts of the waveguide mode.

30. The system of claim 23, wherein the rows correspond to a set of contours of the respective hologram function.

31. A method of controlling a surface scattering antenna with a plurality of adjustable scattering elements, comprising:

reading an antenna configuration from a storage medium, the antenna configuration being selected to reduce artifacts attributable to a discretization of a hologram function; and adjusting the plurality of adjustable scattering elements to provide the antenna configuration;

wherein the adjustable scattering elements are adjustable between a discrete set of states corresponding to a discrete set of function values at each location in a plurality of locations for the plurality of adjustable scattering elements; and wherein the antenna configuration is an error-propagated discretization of the hologram function.

32. The method of claim 31, further comprising:

operating the antenna in the antenna configuration.

33. The method of claim 31, wherein the error-propagated discretization is obtained by an algorithm that includes, for each location in a sequence of the plurality of locations:

identifying an error, if any, accumulated at the location from one or more locations earlier in the sequence of locations;

selecting a function value from the discrete set of function values, the selected value being that value in the discrete set of function values that is closest to a sum of the respective hologram function evaluated at the location and the accumulated error;

identifying a state for the adjustable scattering element at the location, the identified state being selected from the discrete set of states and corresponding to the selected function value for the location;

identifying a new error equal to the selected function value minus the sum of the respective hologram function evaluated at the location and the accumulated error; and accumulating the new error at one or more locations, if any, later in the sequence of locations.

34. The method of claim 33, wherein the plurality of adjustable scattering elements is a one-dimensional plurality of adjustable scattering elements, and the sequence of locations is a sequence of locations of adjacent scattering elements.

35. The method of claim 34, wherein the accumulating of the new error at one or more locations later in the sequence of locations is an accumulating of the new error at a next location in the sequence of locations.

36. The method of claim 33, wherein the plurality of adjustable scattering elements is a two-dimensional plurality of adjustable scattering elements.

37. The method of claim 36, wherein the two-dimensional plurality of adjustable scattering elements is arranged in rows, and the sequence of locations is a row-by-row sequence of locations of adjacent scattering elements in each row.

38. The method of claim 37, wherein the accumulating of the new error at one or more locations later in the sequence of locations is an accumulating of the new error at a next location in the sequence of locations.

39. The method of claim 38, wherein:

if the location is at an end of one of the rows of scattering elements, the accumulating of the new error at the next location in the sequence locations is an accumulating of zero error at the next location in the sequence of locations.

40. The method of claim 37, wherein the accumulating of the new error at one or more locations in the sequence of locations is an accumulating of the new error at multiple locations in a two-dimensional neighborhood of the location.

41. The method of claim 37, wherein the surface scattering antenna includes a plurality of one-dimensional waveguides supporting the two-dimensional plurality of adjustable scattering elements, and the rows coincide with the plurality of one-dimensional waveguides.

42. The method of claim 37, wherein the surface scattering antenna includes a plurality of one-dimensional waveguides supporting the two-dimensional plurality of adjustable scattering elements, and the rows are perpendicular to the plurality of one-dimensional waveguides.

43. The method of claim 37, wherein the surface scattering antenna includes a waveguide supporting a waveguide mode, and the rows correspond to a set of constant phase fronts of the waveguide mode.

44. The method of claim 37, wherein the rows correspond to a set of contours of the respective hologram function.

* * * * *